US005419940A

United States Patent [19]

Wood et al.

[11] Patent Number: 5,419,940

[45] Date of Patent: May 30, 1995

[54] COLORIZED ACRYLIC AWARD ASSEMBLY AND METHOD OF MAKING

[75] Inventors: Cornell D. Wood, Eagan; Clyde L. Anderson, White Bear Lake, both of Minn.

[73] Assignee: Designer Selections, Inc., St. Paul, Minn.

[21] Appl. No.: 114,011

[22] Filed: Aug. 30, 1993

[51] Int. Cl.[6] ..... B32B 9/00

[52] U.S. Cl. ..... 428/13; 428/15; 428/33; 428/38; 428/46; 428/210; 428/542.4; 428/912.2; 428/913.3; 40/427; 40/582

[58] Field of Search ..... 428/13, 15, 33, 34, 428/201, 210, 458, 461, 38, 46, 912.2; 40/427, 582

[56] References Cited

U.S. PATENT DOCUMENTS

| | | | |
|---|---|---|---|
| D. 155,008 | 8/1949 | Herman | 88/6 |
| D. 195,849 | 8/1963 | Sanchez | D29/23 |
| D. 254,428 | 3/1980 | Lasowski et al. | D11/1579 |
| D. 260,009 | 7/1981 | Zieselman | D11/131 |
| D. 267,485 | 1/1983 | Robinson | D11/157 |
| D. 320,177 | 9/1991 | Meekins | D11/157 |
| 1,858,358 | 5/1932 | Cooper . | |
| 2,549,893 | 2/1945 | Cook | 40/125 |
| 3,806,398 | 4/1974 | Lasser | 161/5 |
| 4,268,985 | 5/1981 | Lecznar | 40/219 |
| 4,277,139 | 7/1981 | Cox | 350/286 |
| 4,530,863 | 7/1985 | Seeger | 428/13 |
| 4,546,019 | 10/1985 | Schneider | 428/13 |
| 4,824,729 | 4/1989 | Livi | 428/428 |
| 4,888,251 | 12/1989 | Nakada | 428/542.4 |
| 5,139,828 | 8/1992 | Altmayer | 428/13 |

*Primary Examiner*—Patrick J. Ryan
*Assistant Examiner*—Abraham Bahta
*Attorney, Agent, or Firm*—Merchant, Gould, Smith, Edell, Welter & Schmidt

[57] ABSTRACT

Disclosed are several embodiments (10, 30, 40, 50, 60) of an award assembly having a colorized and reflective appearance. The award assemblies include a base (11, 36, 84, 62) having a reflective surface (18, 87, 72). The award assemblies have three-dimensional uprights or prisms (10, 31, 32, 33, 40, 50, 88, 61) which are made of transparent acrylic. A solvent (25) such as methylene chloride fuses the prism to the base. Also disclosed is a method for making award assemblies.

11 Claims, 3 Drawing Sheets

FIG.1
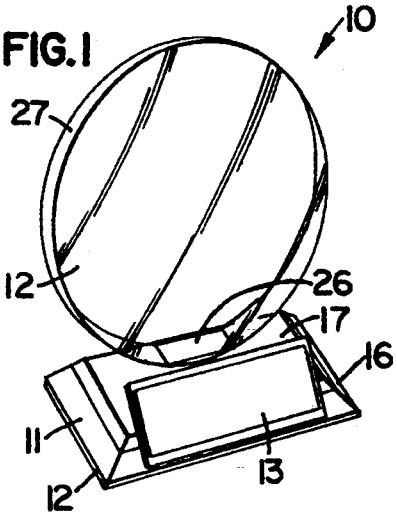
FIG.3
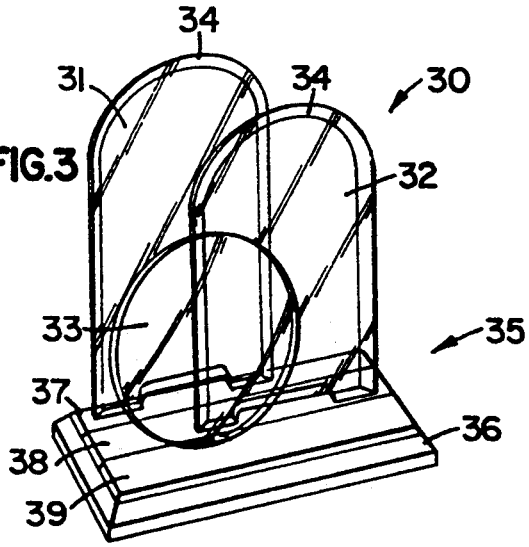
FIG.4
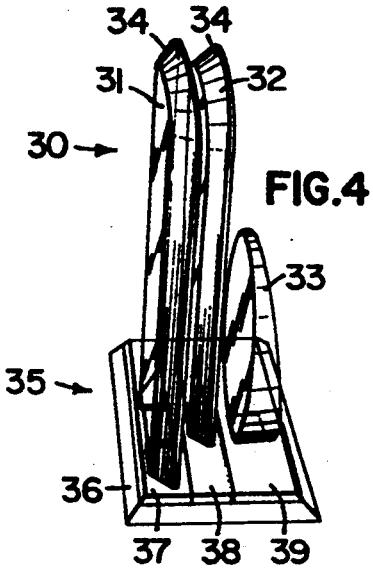
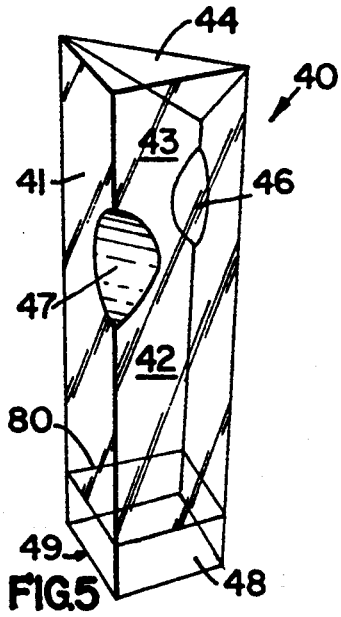
FIG.5
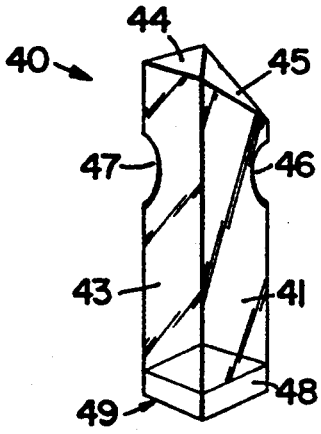
FIG.6

COLORIZED ACRYLIC AWARD ASSEMBLY AND METHOD OF MAKING

FIELD OF THE INVENTION

This invention relates generally to award assemblies and more particularly to an award assembly having colorized and light reflective components.

BACKGROUND OF THE INVENTION

A wide variety of awards are utilized to bestow recognition for various reasons, such as training, service, fund raising, and athletics. Two common forms of such awards are wall plaques and trophies. Another type of award features a horizontal base which supports one or more three-dimensional members or "uprights." The latter type of award may be made from a variety of materials, including acrylic. However, prior awards have been monochromatic or clear, and/or have utilized a solid, opaque base, such as wood. While such award designs are often aesthetically pleasing, they often do not have a dramatic visual impact.

It is therefore an object of the present invention to provide an award having a unique appearance, and a durable construction which is relatively simple to manufacture.

SUMMARY OF THE INVENTION

The present invention is an award assembly, comprising a base having a reflective layer, and an acrylic upright or prism which is adhered to the upper surface of the base by solvent welding means. The reflective layer may be a silver or colored mirror, which is in the form of either a film or a coating. The solvent welding means is preferably methylene chloride. The award is provided with a colored or light-reflective layer, so that incident light reaching the colored or light-reflective base is reflected through the prism. Preferably, a colored acrylic base plate or colored reflective layer is utilized to impart color to portions of the prism, thus further enhancing the attractiveness and luster of the award.

Another aspect of the present invention involves a method of making an award assembly, the method comprising, in general, the steps of: providing a base with a reflective layer, providing a transparent acrylic prism, and fusing the prism to the base.

A primary advantage of the present invention is its aesthetically pleasing appearance. The colorized and reflective components of the present invention result in a dramatic and impressive visual impact. The owner of the award is proud to display the award not only for the accomplishment it represents, but also for the artistic quality of the award. The award assumes an appearance similar to a work of visual and sculptural art.

Additionally, the method of manufacturing the award assembly is relatively simple. The awards may be constructed efficiently in large quantities, and their durable construction minimizes breakage problems.

In accordance with the above advantages and other advantages which will be apparent hereinafter, the invention will now be described with particular reference to the accompanying drawings.

BRIEF DESCRIPTION OF THE DRAWINGS

FIG. 1 is a perspective view of a first embodiment of an award of the present invention.

FIG. 3 is a front, perspective view of a second embodiment of the award of the present invention.

FIG. 4 is a side, perspective view of the embodiment illustrated in FIG. 3.

FIG. 5 is a perspective view of a third embodiment of the award of the present invention.

FIG. 6 is another perspective view of the third embodiment of the present invention, as viewed approximately 90 degrees from the view illustrated in FIG. 5.

DETAILED DESCRIPTION OF THE PREFERRED EMBODIMENTS

Figure 2:
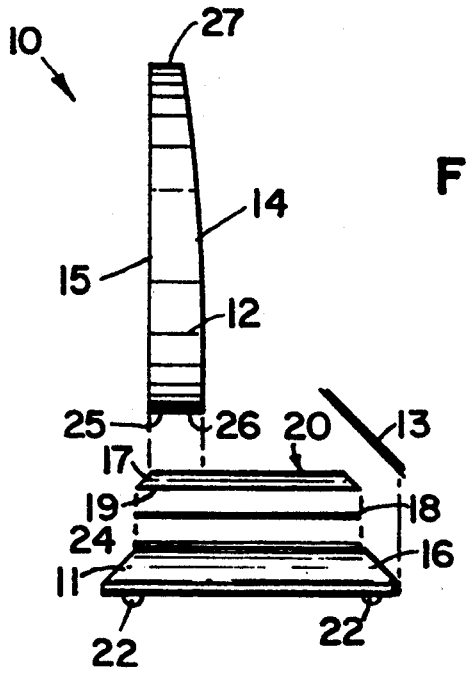
FIG. 2 is an exploded, side elevational view of the award illustrated in FIG. 1.

Referring now to the drawings in detail, wherein like reference numerals indicate like elements, the invention will be described in reference to several embodiments of different award assemblies.

Referring to FIG. 1, an award assembly 10 is illustrated. The award assembly 10 has a base 11, and a three-dimensional upright member 12. Preferably, the base 11 has a plaque 13 upon which the award recipient's name and/or other information is imprinted.

In the preferred embodiment, the upright or prism 12 is made of an acrylic plastic such as methyl methacrylate, which is available commercially as Plexiglass®, Lucite® and the like. This type of acrylic is available in transparent, translucent, and opaque forms. Preferably, the upright 12 is transparent strictly for aesthetic reasons. Other suitable materials such as clear styrene or a clear polycarbonate may also be utilized.

The prism 12, as illustrated in FIG. 1, has a generally circular shape, but may be of any desired shape. Preferably, the upright 12 has a flat rear surface 15 and a tapered front surface 14, as illustrated in the side view of FIG. 2. In the embodiment of FIGS. 1–2, the upright 12 is contoured in shape so as to have a non-uniform thickness. Preferably, the upright or prism 12 is thicker at the bottom and gradually tapers to a smaller thickness toward the top. This contoured shape can be achieved by forming the upright 12 from an injection molding process.

The upright 12 may have words and/or a design imprinted thereon, although no such imprinting is illustrated in FIG. 1. The lettering may be imprinted on the front surface 14, the rear surface 15, or both surfaces 14, 15. Such imprinting may be applied by a stamping process or a screen printing process. With the stamping process, heat and pressure are applied to the foil lettering and/or logo to embed the lettering and/or logo into the acrylic. With the screen printing process, the ink is adhered to the surface of the acrylic. The hot stamping and screen printing processes may produce either an intaglio image or a relief image.

The base 11 may be of any shape but is rectangular in the embodiment of FIGS. 1–2. The base 11 has a flat upper surface 20. Preferably, the underside of the base member 16 is provided with nodules 22 for protecting the table (not shown) or other surface on which the award 10 is placed. The nodules 22 may be made of a suitable material such as rubber or felt.

The base 11 consists of a lower base member 16 and an upper plate 17. In the preferred embodiment, the lower base 16 and plate 17 are made of a tinted, opaque acrylic. The colorized acrylic is produced by adding a suitable dye to the acrylic during the casting process. The tint for the acrylic may be in a powder or liquid form. Preferably, the colorized acrylic is formed into sheets of a desired thickness by a continuous casting process. The base member 16 and plate 17 are cut, etched and polished with suitable machine tools to achieve the desired size and configuration. The components of the acrylic base 11 could also be made from an injection molding, casting, or extrusion process. The lower base member 16 may also be made of wood, artificial marble, artificial granite, or a similar material.

The plate 17 is made of an acrylic polymer and is approximately ⅛ inch in thickness. The plate 17 is machined from a sheet of acrylic having the desired thickness. The plate 17 is preferably colorized, and has a different color from the color of the bottom base member 16. For example, the bottom base member 16 may be black, and the upper plate 17 may be red. The plate 17 may also be made of a clear acrylic, but is preferably a colored, translucent acrylic.

Disposed on the underside 19 of the plate 17 is a light-reflective layer 18. In the preferred embodiment, the reflective layer 18 is a mirror film which may be adhered to the acrylic plate 17 in a hot stamping process which is preferably performed in a vacuum chamber. Alternatively, the reflective layer 18 may be a mirror coating of silvered paint such as is used to create conventional mirrors. The reflective mirror layer 18 is preferably silver, although it may be colorized. The mirrored layer 18 faces upwardly toward the prism 12. The reflective layer 18 is spaced from the prism 12 a distance corresponding to the thickness of the plate 17.

The underside 19 of the plate 17 with its reflective layer 18 is adhered to the upper surface 23 of the bottom base member 16 with double-sided tape 24. That is, the material 24 is a tape coated on both sides with an adhesive material.

The prism 12 has a flat mounting surface 26, which is provided to mate with the upper surface 20 of the base member 11. The prism 12 is secured or welded to the plate 17 by application of a solvent welding means, that is, a suitable solvent 25 such as methylene chloride or a like material. The effect of the solvent 25 is to momentarily dissolve and then reset the acrylic, whereby the mounting surface 26 of the upright 12 is literally fused to the upper surface 20 of the base 11. A suitable device for delivering the solvent to the desired location is a bottle having an elongated needle-like spout. The solvent 25 is transparent.

An unforeseen result of the present invention is that use of the transparent solvent 25 does not obstruct the light, but the light passing therethrough is reflected and colored so as to create a most unusual and pleasing effect. That is, the colored, reflective surface from the plate 17 is reflected into the upright 12, so as to create a dramatic visual effect which varies depending upon the angle from which the award 10 is viewed. In particular, the colorized effect is evident in the contoured, outer edges 27 of the prism 12. This effect is not as dramatic when the solvent 25 is not present at the mounting surface 26.

After the plate 17 is adhered to the bottom base member 16 with the tape 24, the plate 17 and base member 16 are etched, beveled and polished with suitable machining tools, so that their outer perimeter surfaces are preferably flush with each other to form a continuous, sloped surface. Alternatively, the perimeter of the plate 17 could be a vertical surface, so that there is no continuous, sloped surface.

Referring to FIGS. 3 and 4, a second embodiment of an award assembly is shown generally at 30. The award 30 features three uprights or prisms 31, 32, and 33. In the preferred embodiment, the thickness of the uprights 31, 32 is uniform, and each upright 31, 32 is formed and shaped from a sheet of acrylic material with suitable machining tools. Each upright 31, 32 has a beveled perimeter 34, with the beveled surfaces 34 sloping downwardly toward the rear surface of each upright 31, 32. This rearward beveling illustrated in FIGS. 3 and 4 has been found to increase the colorized effect of the present invention. The front upright 33 is similar to the upright 12 illustrated in FIG. 1, and has a non-uniform thickness which is wider toward the bottom of the prism 33. Preferably, the front upright 33 has imprinting (not shown) thereon, and the other uprights 31, 32 have no imprinting.

The award 30 has a base 35 which is substantially similar to the base 11 as described in connection with the award of FIG. 1. That is, the base 35 has a bottom, beveled base member 36 which is adhered to an upper plate having a reflective surface. With the embodiment illustrated in FIGS. 3–4, however, the upper plate consists of three rectangular acrylic plates or sheets 37, 38, 39 which are in parallel, abutting relationship. In the preferred embodiment, the central sheet 38 has a different color from the outer sheets 37, 39. For example, the bottom base member 36 may be black, the central sheet 38 may be red, and the two outer sheets 37, 39 may be blue. Each of the sheets 37, 38, 39 is made of a colorized acrylic and has a reflective layer (not shown in FIGS. 3 and 4) on its bottom surface.

It is to be understood that rather than utilizing a colorized acrylic plate 17 with a silver mirror surface 18, one could utilize a clear acrylic plate with a colored mirror surface, or one could utilize a colored acrylic plate with a colored mirror layer. Each of these designs creates the luminous aesthetic effect achieved by the present invention.

A third embodiment of the present invention is illustrated in FIGS. 5–6, and the award is generally designated as 40. The award 40 is a three-dimensional prism having four vertical side surfaces 41, 42, 43 and 92. The award 40 has no separate base member. The prism 40 is formed from a clear acrylic material, whereby a relatively thick sheet of cast acrylic is cut and machined. The block of acrylic material 40 has a substantially horizontal, flat upper surface 44; a substantially flat, sloping upper surface 45; and a pair of notches or "eyes" 46, 47. The eyes 46, 47 are oppositely disposed, and the eyes 46, 47 are formed symmetrically at the intersection line of the side surfaces 92, 43 and 41, 42 respectively. The eyes 46, 47 are preferably opposite each other, as shown in FIG. 6.

A lower portion 48 of the award 40 is colorized. The colorized portion 48 is integral with the rest of the prism 40. The colorized portion 48 is formed by soaking the bottom portion of the award 40 in a dye. For example, the award 40 could be put in the dye up to the level marked by the line 80. The acrylic member 40, after soaking for the desired amount of time, is rinsed. The dye on the side surfaces 41, 42, 43 and 92 of the prism 40 is then buffed off, so that the dye remains only on the bottom surface of the prism 40. In the preferred embodiment, the dye is alcohol-based. A suitable dye is available commercially under the trademark REZ-N-DYE from Schwartz Chemical Company, Inc. of Long Island City, N.Y.

If desired, the surface of each eye 46, 47 may be colorized by also applying the dye with a brush. If excess dye is applied, it may be buffed off.

The award 40 as described above has a beautiful, colorized appearance, which is especially reflected through the upper surfaces 44, 45; the eyes 46, 47; and the lower portion 48 of the award 40. The presence of the dye on only the bottom surface 49 of the prism 40 gives the award 40 a luster and mystique.

Figure 7:
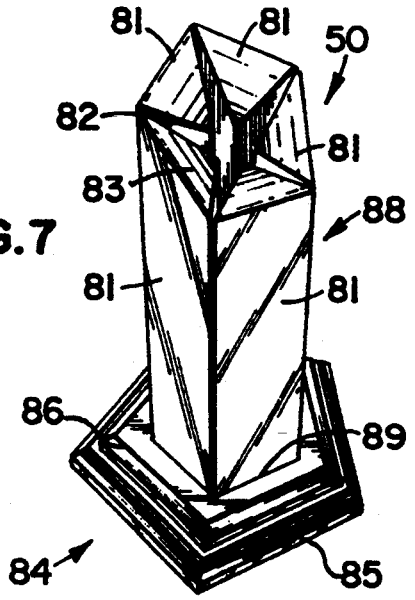
FIG. 7 is a perspective view of the fourth embodiment of the award of the present invention.
Figure 8:
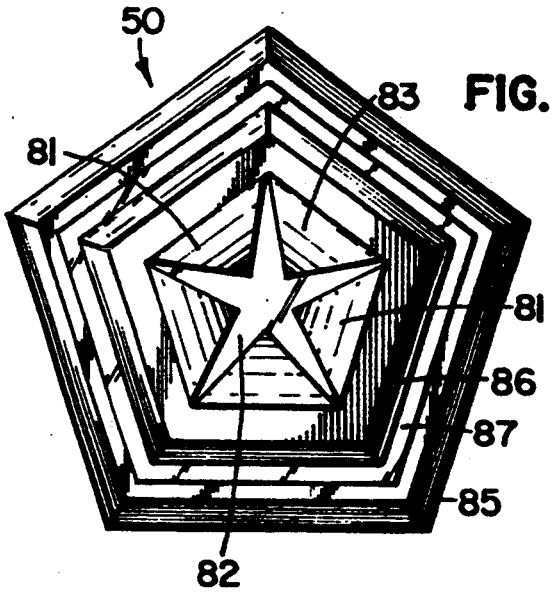
FIG. 8 is a top plan view of the award illustrated in FIG. 7.

A fourth embodiment of the present invention is illustrated in FIGS. 7 and 8, wherein the award assembly is designated generally as 50. The prism structure 88 of the award 50 is formed from a plurality of uprights 81. The uprights 81 are each triangular in cross section, having three vertical side surfaces. The uprights 81 are sized and configured so as to form an internal space 82 having a desired shape, such as the star shape illustrated in FIGS. 7 and 8. The upper surface 83 of each upright 81 is slanted, so as to provide a continuous, sloping surface to top of the overall prism assembly 88. In the preferred embodiment illustrated, there are five upright members 81, with each of the uprights 81 being made from a clear acrylic material.

The award 50 has a base 84, which is preferably shaped like a pentagon. The base 84 has a lower base member 85, and an upper template member 86. Between the lower base 85 and the template 86 is a colorized mirror border 87. The colorized mirror border 87 may be either a colored mirror film or coating, or it may be an acrylic sheet to which is adhered a mirror layer. For example, the lower base 85 and upper template 86 may be of a black acrylic material, with the colorized mirror border 87 being green.

The template 86 completely surrounds the upright members 81, and has a central pentagonal opening 89 therein for positioning of the upright members 81. Beneath the uprights 81 is a colorized plate or substrate (not shown). In the preferred embodiment, the colorized plate is pentagonal in shape, to correspond with the cross-sectional shape of the prism assembly 88. The colorized plate may be formed from a plurality of sheets having different colors. For example, the pentagonal substrate may be made up of five triangular shaped sheets, each triangular sheet having a desired color and positioned beneath one of the uprights 81. The colorized plate may be either a colorized mirror surface, or it may be a colorized acrylic sheet beneath which is disposed a mirror layer.

Figure 9:
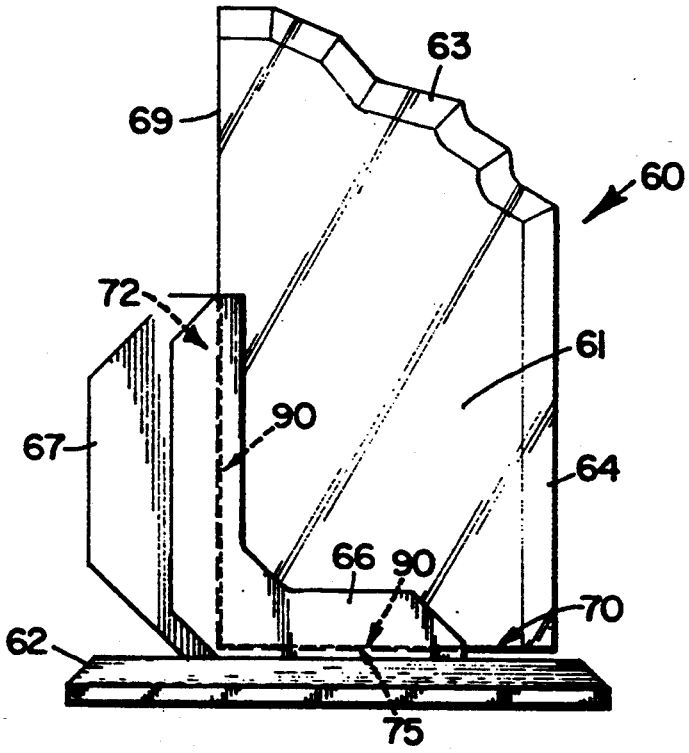
FIG. 9 is a side elevational view of a fifth embodiment of the present invention.
Figure 10:
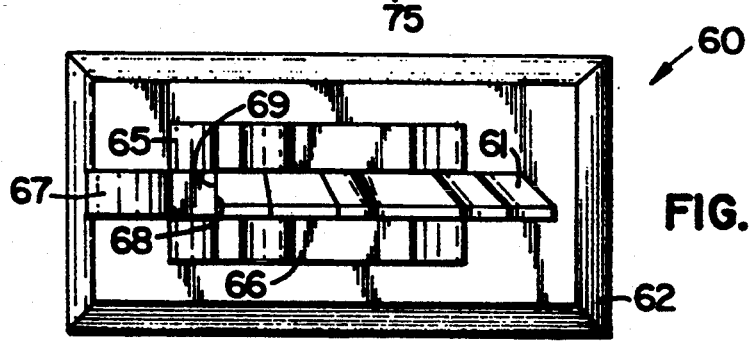
FIG. 10 is a top plan view of the award illustrated in FIG. 9.

A fifth embodiment of the present invention is illustrated in FIGS. 9 and 10, wherein the award assembly is designated generally as 60. The award 60 has an upright 61 and a base 62. As shown in FIG. 9, the upright 61 has a horizontal bottom surface 70; a pair of vertical side surfaces 64, 69; and an jagged upper surface 63. In the preferred embodiment, the upright's top and side perimeters 63, 69, 64, are beveled rearwardly so that the rear surface area of the upright 61 is smaller than the front surface area.

The upright or prism 61 is positioned between two L-shaped supports 65, 66 which are disposed on either side of the upright 61. The supports 65, 66 have symmetrical notches (not shown) which provide a horizontal support surface 75 for the prism 61. Additionally, a support member 67 is disposed on one side of the upright 61. In the preferred embodiment, the base 62 and support members 65, 66, 67 are made of an opaque acrylic material, and each of these members 62, 65, 66, 67 has the same color.

The inner, vertical side surface 72 of the support 67 abuts against the side 69 of the upright 61, and the horizontal surface 75 of the support members 65, 66 abuts against the bottom surface 70 of the upright 61. With the embodiment illustrated in FIGS. 9–10, a reflective layer 90 is applied to the vertical and horizontal surfaces 72, 75 of the support members 65, 66, 67 which abut against the side and bottom surfaces 69, 70 of the upright 61. In the embodiment illustrated in FIGS. 9–10, a colorized mirror is utilized, and there is no colorized acrylic member to which the mirror's surface is reflected, such as what was described with the plate 17 of the first embodiment. For example, the support members 65, 66, 67 could be black, and the reflective surface 90 could be a green mirror. In this manner, the reflective layer 90 is not visible to a person viewing the award 60, because the opaque support members 66, 67, 68 hide the reflective layer 90 from view. However, this design produces a colorized, sparkling effect which is created by the reflective layer 90 being reflected through the upright 61 and particularly through the beveled perimeter surfaces 63, 64.

To summarize, the award assemblies of the present invention are made from a base member and a preferably transparent prism or upright. The base member has a reflective, mirrored surface and/or a dyed surface as disclosed in the embodiment of FIGS. 5–6. The award may be provided with one or more prism members, which may have imprinting thereon. The base is provided with a reflective layer, which may be a colored acrylic plate having a mirrored surface thereon, or a colorized mirror film or coating. Preferably, the upright(s) have beveled surfaces to further enhance the visual effect. The uprights and base members may be made from a casting or injection molding process, and the members are machined to be of the desired size and configuration. The prisms may also have a dye applied to portions of their outer surfaces.

While preferred embodiments of the invention and a manner of making the invention have been shown and described, it should be apparent that many modifications can be made without departing from the spirit and scope of the invention. Accordingly, the invention is not limited by the foregoing description, but is limited only by the scope of the claims.

What is claimed is:

1. An award assembly comprising:

(a) a base having an upper and a lower surface, wherein said base includes a lower opaque base member and an upper plate, said upper plate being made of a colorized acrylic material, a bottom surface of said plate including a planar reflective layer which extends beneath said upper surface of said base;

(b) a three-dimensional, integral prism, said prism being made of an acrylic material; and (c) solvent welding means for adhering said prism to said upper surface of said base.

2. An award assembly according to claim 1, wherein said reflective layer comprises a mirrored film.

3. An award assembly according to claim 1, wherein said reflective layer comprises a mirrored coating.

4. An award assembly according to claim 1, wherein said reflective layer comprises silver mirror means.

5. An award assembly according to claim 1, wherein said reflective layer comprises colorized mirror means.

6. An award assembly according to claim 4, wherein said base member and said upper plate are adhered by double-sided adhesive tape.

7. An award assembly according to claim 1, wherein said prism includes a beveled surface opposite said reflective layer.

8. An award assembly according to claim 1, wherein said solvent welding means comprises methylene chloride.

9. An award assembly according to claim 8, wherein said plate comprises a plurality of sheets having different colors.

10. An award assembly according to claim 8, wherein said award assembly has a plurality of prisms, at least one of which has imprinting thereon.

11. An award assembly comprising:

(a) an opaque base member including an upper plate, said upper plate being made of a colorized acrylic material, said base member including a continuous reflective layer beneath said upper plate;

(b) a three-dimensional, integral prism made of an acrylic material, said prism having a non-uniform thickness; and (c) solvent welding means for adhering a bottom surface of said prism to said upper plate of said base member.

* * * * *